US006102661A

United States Patent [19]

Robson et al.

[11] Patent Number: 6,102,661

[45] Date of Patent: Aug. 15, 2000

[54] PROPELLER WITH ANNULAR CONNECTING ELEMENT INTERCONNECTING TIPS OF BLADES

[75] Inventors: Martin Robson; Eddie Hofmeister, both of Dingley, Australia

[73] Assignee: SPI LTD, Australia

[21] Appl. No.: 08/849,705

[22] PCT Filed: Dec. 6, 1995

[86] PCT No.: PCT/AU95/00826

§ 371 Date: Dec. 29, 1997

§ 102(e) Date: Dec. 29, 1997

[87] PCT Pub. No.: WO96/17769

PCT Pub. Date: Jun. 13, 1996

[30] Foreign Application Priority Data

Dec. 6, 1984 [AU] Australia ..... PM 9879

[51] Int. Cl.[7] ..... B63H 1/16

[52] U.S. Cl. ..... 416/189; 416/191; 416/192; 416/194; 416/195; 416/228; 416/237; 416/247 A

[58] Field of Search ..... 416/189, 191, 416/192, 194, 195, 228, 237, 247 A

[56] References Cited

U.S. PATENT DOCUMENTS

| | | | |
|---|---|---|---|
| 5,096,382 | 3/1992 | Gratzer | 416/189 |
| 5,405,243 | 4/1995 | Hurley et al. | 416/189 |
| 5,413,465 | 5/1995 | Daniel | 416/189 |

FOREIGN PATENT DOCUMENTS

| | | | |
|---|---|---|---|
| WO 92/10402 | 6/1992 | WIPO | 416/189 |

*Primary Examiner*—Edward K. Look
*Assistant Examiner*—Matthew T. Shanley
*Attorney, Agent, or Firm*—Kyle W. Rost

[57] ABSTRACT

A propeller (10) including a hub (11), a plurality of blades (13) extending outwardly from the hub (11) and part annular connecting elements (17) which interconnect tips (16) of adjacent blades (13). The trailing edges (21) of the elements (17) extend from the trailing edge of one blade (13) at its tip to intersect the adjacent blade (13) at a relief point (23) on the high pressure side of the blade (13) between the leading and trailing edges of the blade (13). The leading edge (20) of the elements (17) extends from the leading edge of a blade (13) at its tip (16) to intersect the adjacent blade (13) at a relief point (25) on the low pressure side of the blade (13) intermediate the leading and trailing edges of the blade (13) at its tip (16).

10 Claims, 2 Drawing Sheets

PROPELLER WITH ANNULAR CONNECTING ELEMENT INTERCONNECTING TIPS OF BLADES

This application has been filed under 35 U.S.C. 371 and claims foreign priority benefits under 35 U.S.C. 119 of PCT/AU95/00826, filed Dec. 6, 1995, which is based upon Australian patent, Serial#: PM 9879, filed Dec. 6, 1994.

TECHNICAL FIELD

This invention relates to improvements to propellers and in particular to improved marine propellers.

BACKGROUND ART

Many different propeller constructions have been proposed in the past and are presently available. Some propellers which have been proposed incorporate a ring or shroud which surrounds the propeller blades and is fixed thereto so as to be rotatable with the blades. The aim of such shrouds is to direct energy rearwardly from the propeller, rather than losing energy as a result of centrifugal action. Such propellers have not proved particularly effective and often have substantially decreased efficiency compared to normal unshrouded propellers. In particular, excessive pressure can build up within the ring and furthermore, viscous drag which occurs about the ring as it rotates builds up a rotational boundary layer about the ring increasing the effective drag area of the propeller.

One such propeller is disclosed in International Patent Application No. PCT/AU91/00582. The propeller described in that document includes an annular ring which joins the tips of the blades of the propeller and leaves free a region only on the high pressure side of the blades. It has been found in practice that this propeller has some disadvantages.

Other propellers have been provided with tip or end plates at the end of the propeller blades for distributing the vortices from the blades so that minimum kinetic energy losses occur. Current tip and end plate designs have had limited success.

DISCLOSURE OF THE INVENTION

The present invention aims to provide in one aspect an improved propeller, particularly suited to marine applications which functions efficiently and which is safe in operation. The present invention also aims in a preferred aspect to provide a propeller which prevents excessive vortex formations, particularly at the tips of the blades of the propeller. Other objects and advantages of the invention will become apparent from the following description.

The present invention thus provides in a first preferred aspect a propeller having a central hub, a plurality of blades spaced around said hub and extending outwardly of said hub and having outer tips, and annular connecting means joining said tips of respective said blades, said annular connecting means joining adjacent said blades on the leading and trailing sides thereof respectively and leaving a region of each said blade at said tips on the leading and trailing sides free for outward flow of liquid.

The annular connecting means may be in the form of part annular connecting elements having leading and trailing edges, relative to the normal forward direction of movement of the propeller, the annular connecting elements extending around and lying on or substantially on the surface of imaginary cylinder arranged concentrically with the propeller hub. In one form, the trailing edge of each annular connecting element may extend between the trailing edge of one blade at its tip and a first relief point on the pressure side or back face of the adjacent blade at the blade tip, the relief point being disposed intermediate the leading and trailing edges of the blade at the tip. The pressure side or back face of the blade is the side of the blade facing rearwardly with respect to the direction of forward movement of a water craft with which the propeller is used. The leading edge of each connecting element may extend from a second relief point on the negative pressure or suction side of a blade intermediate the leading and trailing edges of the blade at its tip and the leading edge of the adjacent blade at its blade tip. The negative pressure or suction side of the blade is the side of the blade facing forwardly relative to the direction of movement of the water craft with which the propeller is used.

In one preferred form, the annular connecting elements may be of substantially constant width in the axial direction and for this purpose the leading and trailing edges of the element are substantially parallel to each other. The annular elements between the respective blades may be arranged along a helix or helixes on the centred on the rotational axis of the propeller and thus are angled to the axis of the propeller. The first and second relief points may be positioned directly opposite each other on opposite sides of a blade at its tip. The relief points however may be positioned at any location between the leading and trailing edges of the blade at the blade tip.

The elements joining the blade tips, however, may be in an alternative configuration. For example, the trailing edges of the elements may extend rearwardly beyond the trailing edges of the blades at the tip. Similarly, the leading edges of the blades may extend forwardly beyond the leading edges of the blades at the blade tips.

Furthermore, whilst the leading and trailing edges of the elements preferably straight or curved uninterrupted linear form, they may be stepped or provided with shoulders along their length.

Propellers according to the present invention may have a similar external diameter to the diameter of a conventional open propeller or may be of larger or smaller diameter than an equivalent conventional propeller.

The pitch of the blades of the propeller may be constant along their length or may have a variable face pitch with pitch diminishing from the root of the blade (at the hub) to the tip of the blade.

The propeller of the invention may have any number of blades ranging from two upwards, however, practically two to six blades prove most efficient. The blades may be fixed to the hub or formed integrally with the hub to extend outwardly therefrom.

In most outboard configurations the hub diameter ratio has a set mean which is enforced by the need to exit exhaust gases through the hub. Similar ratios may be employed in the propellers of the invention. In non exhaust vent hubs however, the propeller may have a hub of smaller diameter and mass as allowed by the additional structural integrity imparted to the blade hub connection by the support of the blades by the annular elements. The mean width ratio of the propellers fall within known parameters for conventional open and shrouded propellers.

In cross-section, the blades of the propeller may have lower or higher chord ratios than conventional propeller ratios. In some forms the blades may in cross-section have parallel curved faces whilst for higher rotational speeds, blades with a general wedge shaped cross-section with the widest section being the trailing edge are advantageous.

In propellers according to the invention wherein the blades are supported by the annular elements the blade thickness may be reduced because of the reduced need for cantilever strength due to the support of the tips by the annular elements.

Blade contours can differ from most conventional open propellers and can be parallel sided or varying in width from root to tip.

As with conventional propellers the skew or sweep of the blades falls within the general design rules, that is no skew or sweep for lower rotational and surface speed propellers to increased skew or sweep for higher surface and rotational speed.

A blade rake angle of zero degrees is suited to low speed (displacement vessel) operations whereas for higher speeds (planing vessels), it is preferred to have a positive blade rake to minimize the drag effects created by the rotational boundary layers generated by the annular connecting elements or tips due to viscous drag.

The annular connecting means of the invention serve to contain vortices on either side of the blades and additionally reduce tip vortices. This minimizes viscous drag and allows rotational speeds similar to that of conventional open propellers. The propellers are thus suitable for outboard motor applications where maximum power and torque values are obtained at near maximum engine RPM. The annular elements are shaped to provide minimum viscous drag as presented to the water flow and as the elements intersect the blades at relief points which allow outward flow of liquid, rotational boundary layers as encountered in current ring propellers are reduced.

The relief point on the pressure side of the blade may be less than 0.5 blade width at its intersection and attachment to the elements from the trailing edge of the blade. By moving the relief point rearwardly, that is towards the trailing edge of the blade, and thus increasing the amount of the blade tip encompassed by the element, the discipline imposed on the water race is increased. This increases the thrust capability of the device at lower speeds and is useful for high bollard pull applications.

The positioning of the relief points further defines the amount of viscous drag penalty, and this becomes an important feature of the device when determining specific design criteria. As stated however the relief points may be positioned anywhere between the leading and trailing edges of the blade depending upon the application.

The cross-sectioned shape of the annular elements varies with the duty performance required by the propeller as matched to the vessel. The elements may have an external face along its length which is angled or parallel to the central axis. The elements may also have an external foil or ogival shape.

The internal profile of the elements may be of foiled shape, have leading or trailing edge relief tapers or curved faces parallel or angled to the centre axis. The elements may also have parallel outer and inner faces which are angled to the central axis of the hub. The leading edge of the elements may be rounded or tapered to a point with either or both internal and external relief angles. The trailing edge may be rounded, tapered, square or feathered to a point.

In one form, the elements may be of an aerofoil cross-section. In further forms the inner face of the elements may be planar or concave.

The hub may be parallel or tapered to the central axis and at the trailing edge, the hub may exhibit a profile of constant cross section or be developed conically or flared outwardly in an alternative manner so as to increase in diameter. The conical or flared development will usually commence at a point not greater than 20% of the hub length when measured from the trailing edge. This conical or flared development will assist in extending the disciplined section of the water race avoiding premature disintegration.

BRIEF DESCRIPTION OF THE DRAWINGS

In order that the invention may be more readily understood and put into practical effect, reference will now be made to accompanying drawings which illustrate a preferred embodiment of the invention and wherein.

DETAILED DESCRIPTION OF MODES FOR CARRYING OUT THE INVENTION

Figure 1:
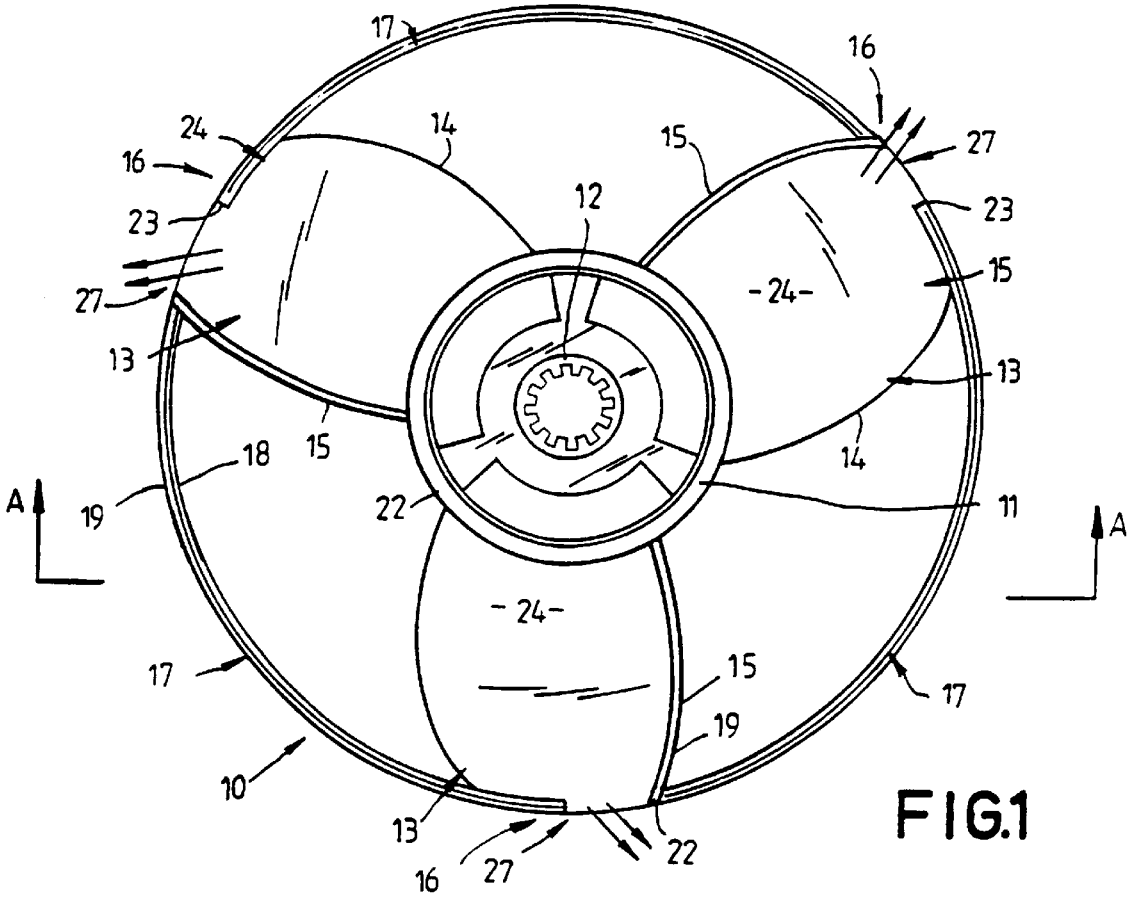
FIG. 1 is a plan view of a propeller according to the present invention.

Referring to the drawings, there is illustrated a propeller 10 according to the present invention including a central hub 11 of generally cylindrical form and including a splined sleeve 12 so as to enable the propeller to be mounted to the splined driving shaft of a drive motor, for example an outboard motor. The hub 11, of course may be provided with any means known in the art to enable it to be mounted to a drive shaft such as by means of a pin extending diametrically through the hub and shaft.

Figure 4:
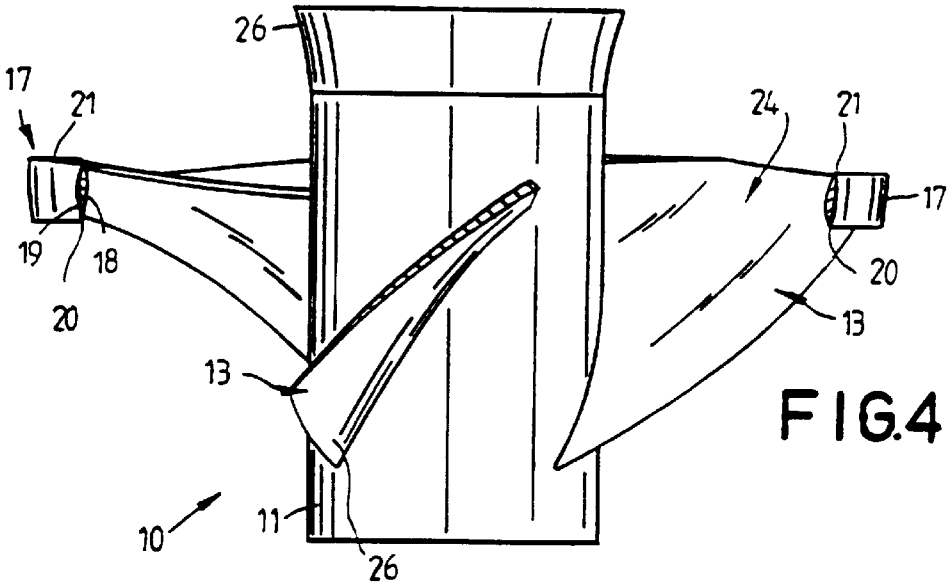
FIG. 4 is a sectional view of the propeller along line A—A of FIG. 2.

Fixed to the hub 11 and extending outwardly therefrom are a plurality of blades 13, in this instance three which may be either formed integrally with the hub 11, for example by being cast therewith or secured to the hub 11 by welding or other means. In this embodiment and is more apparent in FIG. 4, the blades 13 have a varying pitch from root to tip, and preferably curved leading and trailing edges 14 and 15 which taper to the tip 16 of the blade 13.

A plurality of part annular connecting elements 17 are provided between the respective blades 13, the elements 17 being arranged in a direction, looking axially of the hub 11, on a common radius and concentrically with the hub 11 and being fixed or joined to the outer ends or tips 16 of the blades 13. The elements 17 may either be formed integrally with the blades 13 or secured thereto for example by welding. In effect, the elements 17 extend around and lie on the surface of an imaginary cylinder centred on the axis of the hub 11 (shown in FIG. 2). The inner face 18 of the elements 17 in this embodiment is curved as is the outer face 19, the faces 18 and 19 thereby tapering towards the leading and trailing ends of the propeller 10 in the manner shown in FIG. 4 to be of an aerofoil type cross-section. The elements 17, however, may have parallel or substantially parallel outer and inner faces 17 and 18 so as to be of constant cross section or be of other cross sectional form as referred to above.

Figure 2:
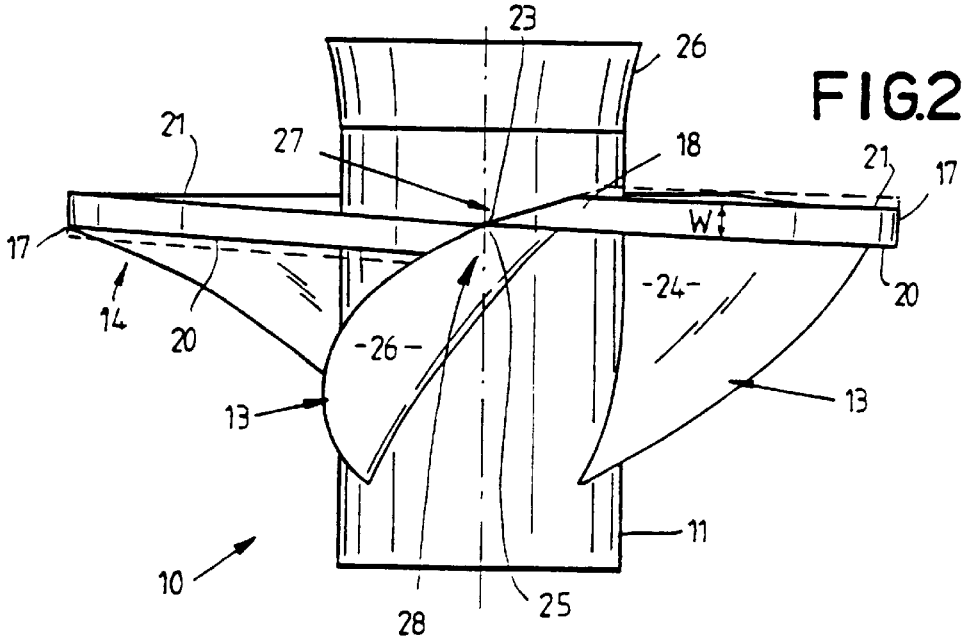
FIG. 2 is a side elevational view of the propeller of FIG. 1.
Figure 3:
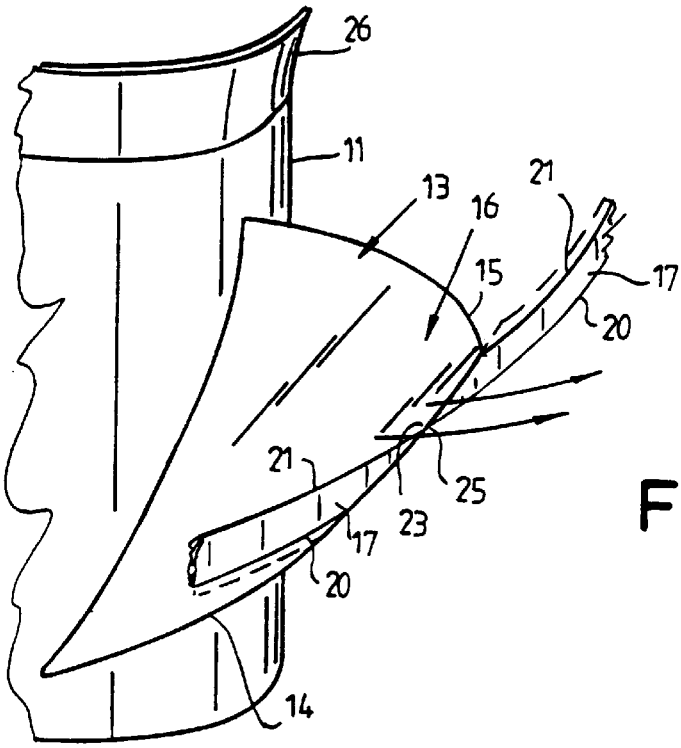
FIG. 3 is a perspective view illustrating portion of the shroud and associated propeller blade of the propeller.

As shown more clearly in FIGS. 2 and 3 the elements 17 preferably have a substantially constant width (W) relative to the axial direction of the hub 11 and thus the leading and trailing edges 20 and 21 respectively are substantially parallel. Additionally, the trailing edge 21 of each element 17 extends between the trailing edge 22 of one blade 13 at its tip 16 and a relief point 23 where it intersects and joins the next blade 13 at its tip 16, the relief point 23 being arranged intermediate the leading and railing edges 14 and 15 of the blade 13 on the high pressure side or face 24 thereof.

The leading edge 20 of each element 17 extends from a relief point 25 on the low pressure side or face 26 of the blade 13 intermediate the leading and trailing edges thereof at the tip 16, to the trailing edge 27 of the blade tip 16 of the next blade 13.

Figure 5:
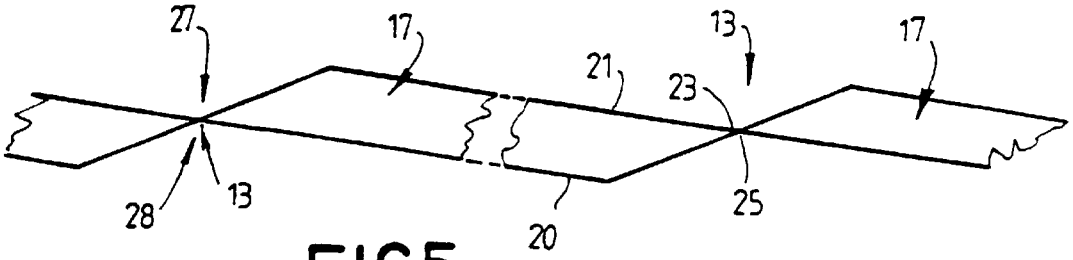
FIG. 5 is a developed view showing the configuration of the blade joining elements of the invention.

The elements 17 thus in their circumferential direction are inclined to the axis of the hub 11 as shown more clearly in FIG. 5 and extend substantially along a helix or helixes centred on the axis of the hub 11. The leading edge 20 is thus at an acute angle to the hub axis, whilst the trailing edge 21 is at an obtuse angle to the hub axis.

In the embodiment illustrated, the relief points 23 and 25 are directly opposite each other on opposite sides of each blade 13. The relief points 23 and 25 on either side of the blade 13, however, may be in any position between the leading and trailing edges of the blade 13 at its tip 16.

The hub 11 of the propeller 10 may include on its trailing side an outwardly flared portion 26 which is of curved form in this embodiment but which may be conical or outwardly divergent in any other manner. The flared portion 26 provides for further guided movement of water rearwardly of the propeller 10 upon rotation thereof.

Upon rotation, and on the high pressure side 24 of the blades 13, the regions 27 free of the elements 17 relieve build up of pressure within the elements 17 by permitting outward flow of water as indicated by the arrows in FIGS. 1 to 3. Additionally, water escaping outwardly through the region 27 hinders the development of vortices at the tips 16 of the blades 13 and confines the vortices about the elements 17.

On the low pressure side 26 of the blades 13, the elements 17 constrain the water flow to concentrate the low pressure area to thereby increases thrust. The elements 17 also serve to reduce tip vortices. Additionally, the regions 28 free of the elements 17 on the low pressure side of the blades 13 permit outward flow of water.

The elements 17 also serve, as well as an annular support to the blades 13, as a safety device so that the tips 16 of the blades 13 are not exposed. Thus, damage to marine life will be substantially reduced and similarly the risks of damage to persons struck, inadvertently by such a propeller 10 will also be reduced. The annular elements 17, furthermore form a nozzle about the axis of the propeller. Depending upon the angle of the elements 17 in relation to the axis of the propeller, the elements may effectively form a divergent or convergent nozzle about the blades 13.

The propellers of the invention may be formed of any suitable material with particular preferred materials being cast aluminium or moulded plastics. The use of the elements 17 makes the propellers 10 particularly suited for manufacture from plastics such as by an injection moulding technique as the blades may be of thinner cross-section as the elements 17 enhance structural rigidity. This permits less material to be used thereby reducing cost of manufacture and increasing production efficiency. The elements 17, of course, may also extend beyond the blades 13 in an axial direction to the trailing and/or leading side of the blades as shown in dotted outline in FIGS. 2 and 3, provided that a region on the trailing side is left open for outward passage of water as described.

The width of the annular elements 17 in the axial direction depends upon the application however generally the width is in the range of 0.1 to 0.25 of the effective diameter of the annular connecting elements 17. Maximum thickness of the elements may typically be in the range of 0.015 to 0.1 of the effective diameter of the elements 17.

Whilst the above has been given by way of illustrative embodiment of the invention, all such modifications and variations thereto as would be apparent to persons skilled in the art are deemed to fall within the broad scope and ambit of the invention as herein defined in the appended claims.

We claim:

1. A propeller having a central hub, a plurality of blades spaced around said hub and extending outwardly of said hub and having outer tips, and annular connecting means joining said tips of respective said blades, said connecting means joining adjacent said blades on the leading and trailing sides thereof respectively and leaving a region of each said blade at said tips on the leading and trailing sides free for outward flow of liquid.

2. A propeller according to claim 1 wherein said annular connecting means comprises part annular connecting elements connecting adjacent said blades.

3. A propeller according to claim 2 wherein said hub has a central axis and wherein said annular connecting elements extend around and lie substantially on the surface of an imaginary cylinder concentric with said hub.

4. A propeller according to claim 3 wherein said blades have leading and trailing edges relative to their normal direction of rotation and wherein said annular connecting elements have leading and trailing edges relative to the normal forward direction of movement of said propeller.

5. A propeller according to claim 4 wherein said trailing edge of each said connecting element extends between the trailing edge of one said blade at its tip and a first relief point on the pressure side of the adjacent said blade, said first relief point being disposed between said leading and trailing edge of said adjacent blade at said tip.

6. A propeller according to claim 5 wherein said leading edge of each said connecting element extends from a second relief point on the suction side of one blade intermediate the leading and trailing edges of said one blade at its tip and the leading edge of an adjacent said blade at its tip.

7. A propeller according to claim 6 wherein said connecting elements have a substantially constant width in the axial direction.

8. A propeller according to claim 6 wherein said annular connecting elements lie along a helix or helixes centred on said central axis of said hub.

9. A propeller according to claim 6 wherein the respective said first and second relief points are disposed directly opposite each other on opposite sides of each said blade.

10. A propeller according to claim 6 wherein said annular connecting elements have in cross-section a substantially aerofoil configuration.

* * * * *